US008020610B2

(12) United States Patent
Soldner et al.

(10) Patent No.: US 8,020,610 B2
(45) Date of Patent: Sep. 20, 2011

(54) EXHAUST GAS HEAT EXCHANGER AND METHOD OF OPERATING THE SAME

(75) Inventors: Jörg Soldner, Ehningen (DE); Sven Thumm, Metzingen (DE); Roland Strähle, Unterensingen (DE); Harald Schatz, Reutlingen (DE)

(73) Assignee: Modine Manufacturing Company, Racine, WI (US)

( * ) Notice: Subject to any disclaimer, the term of this patent is extended or adjusted under 35 U.S.C. 154(b) by 1194 days.

(21) Appl. No.: 11/702,755

(22) Filed: Feb. 6, 2007

(65) Prior Publication Data

US 2007/0181294 A1 Aug. 9, 2007

(30) Foreign Application Priority Data

Feb. 7, 2006 (DE) ..... 10 2006 005 362

(51) Int. Cl.
*F28D 7/16* (2006.01)
*F28F 3/06* (2006.01)

(52) U.S. Cl. ..... 165/82; 165/157; 165/166

(58) Field of Classification Search ..... 165/81, 165/82, 152, 53, 157, 166
See application file for complete search history.

(56) References Cited

U.S. PATENT DOCUMENTS

| | | | | |
|---|---|---|---|---|
| 2,488,807 | A * | 11/1949 | Currie | 165/82 |
| 2,680,600 | A * | 6/1954 | Rothemund | 165/82 |
| 2,990,163 | A * | 6/1961 | Farrell | 165/109.1 |
| 3,291,206 | A * | 12/1966 | Nicholson | 165/166 |
| 3,734,135 | A * | 5/1973 | Mosier | 138/38 |
| 3,893,509 | A * | 7/1975 | Satchwell et al. | 165/166 |
| 5,209,289 | A * | 5/1993 | Haushalter | 165/109.1 |
| 6,293,338 | B1 * | 9/2001 | Chapman et al. | 165/166 |
| 6,357,396 | B1 * | 3/2002 | Stansfield et al. | 165/166 |
| 6,530,425 | B2 * | 3/2003 | Wehrmann et al. | 165/166 |
| 2002/0153129 | A1 * | 10/2002 | White et al. | 165/152 |
| 2004/0226694 | A1 * | 11/2004 | Dilley et al. | 165/82 |

FOREIGN PATENT DOCUMENTS

| | | |
|---|---|---|
| DE | 103 49 150 | 5/2005 |
| DE | 10 2004 050 567 | 6/2005 |
| EP | 13 48 924 | 10/2003 |
| EP | 15 41 954 | 6/2005 |
| WO | 03/0 36 214 | 5/2003 |
| WO | 03/0 64 953 | 8/2003 |
| WO | 03/0 91 650 | 11/2003 |

* cited by examiner

*Primary Examiner* — Leonard Leo
(74) *Attorney, Agent, or Firm* — Michael Best & Friedrich LLP

(57) ABSTRACT

The invention relates to an exhaust gas heat exchanger in an exhaust gas recirculation arrangement. The heat exchanger includes a plate stack which is surrounded by a housing. The plate stack can include two plates which are connected at their longitudinal edges to form a flat tube which contains a turbulator through which exhaust gas flows. The heat exchanger can also include a coolant duct which is equipped with flow directing elements arranged between two flat tubes. In order to make the exhaust gas heat exchanger more resistant to changing temperature stresses, the invention provides that the flow directing elements can be formed from a corrugated plate in which ducts with inlets and outlets are formed. At least some of the ducts in the inlet area of the coolant have a nonlinear profile so that changes in length are permitted between the plate stack and the housing.

14 Claims, 7 Drawing Sheets

EXHAUST GAS HEAT EXCHANGER AND METHOD OF OPERATING THE SAME

CROSS-REFERENCE TO RELATED APPLICATIONS

Priority is hereby claimed to German Patent Application No. DE 10 2006 005 362.1, filed Feb. 7, 2006, the entire contents of which is incorporated herein by reference.

BACKGROUND

The present invention relates to an exhaust gas heat exchanger in an exhaust gas recirculation arrangement.

SUMMARY

European Patent No. 1 348 924 A2 discloses a gas heat exchanger. However, the exhaust gas temperatures of motor vehicle engines, and accordingly, also the temperature differences between the coolant and the exhaust gas are increasing. This causes fracturing and similar damage caused by excessively high temperature stresses and can result in the failure of the entire system.

Work has already been carried out on improving exhaust gas heat exchangers in terms of their resistance to changing temperature stresses. PCT Application No. WO 03/036214A1 discloses a system having slits and a folding bellows arranged in a housing, as a result of which the expansion characteristics of the individual parts of the exhaust gas heat exchanger can certainly be improved. PCT Application No. WO 03/064953 discloses merely one or more expansion beads in the housing casing. PCT Application No. WO 2003/091650 discloses a sliding seat arrangement.

Because the flow directing elements of the present invention are constructed as a corrugated plate in which ducts with inlets and outlets extend in a longitudinal direction, or alternatively, in a transverse direction, with at least some of the ducts having a bent profile at least in the inlet area of the coolant, the flow speed of the entering coolant is selectively increased and the flow is deflected or distributed over as much of the area of the plate as possible. As a result, the temperature differences can be selectively lowered.

Some embodiments of the present invention are particularly effective when the inlet for the coolant is located in the vicinity of the inlet for the exhaust gas so that the exhaust gas heat exchanger can have a parallel flow. The inventors have found that parallel flow through the heat exchanger is more favorable in terms of reducing temperature stresses. The inclusion of a bend in the duct adjacent to the inlet ensures that there is a high flow speed of the coolant, which also prevents the liquid coolant from changing into a gaseous state.

In exhaust gas heat exchangers with ducts which are oriented in the longitudinal direction of the corrugated plate, the corrugated plate can be configured at the two longitudinal edges in such a way that the coolant is prevented from flowing between the edges of the plate and the housing. This contributes to concentrating the flow on the areas in the ducts which are configured for heat exchange.

In some embodiments, the structural complexity of the present invention remains at an acceptable level if the longitudinal edges of the plate are bent over and bear against the adjoining flat tube and are connected (e.g., soldered) thereto. In other embodiments, other connecting technologies and techniques can also or alternatively be used, such as, for example, brazing and welding.

The corrugated plate can have planar edges in the inlet area to support the aforementioned distribution of coolant.

Adjacent to the inlet area, the ducts can have a generally straight design, and in one exemplary embodiment, the ducts can extend in the longitudinal direction of the exhaust gas heat exchanger. In other embodiments, the ducts are oriented essentially in the transverse direction of the exhaust gas heat exchanger.

Other aspects of the invention will become apparent by consideration of the detailed description and accompanying drawings.

DETAILED DESCRIPTION

Figure 1:
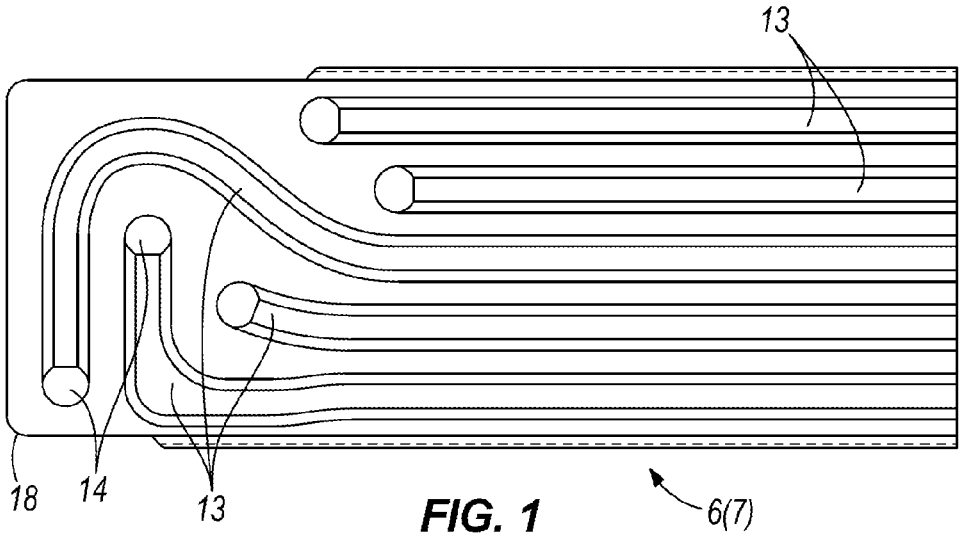
FIG. 1 is a plan view of a flow directing element of the present invention.
Figure 2:
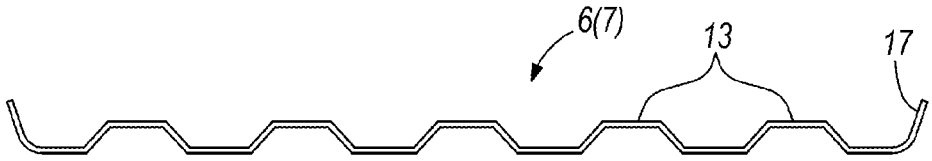
FIG. 2 is a sectional view of a portion of the flow directing element shown in FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The integration of the exhaust gas heat exchanger into an exhaust gas recirculation arrangement has not been shown in prior devices. In the illustrated embodiment of FIGS. 1-12, plates have been used. In each embodiment, two plates form one flat tube and provide a plate stack. In contrast, FIG. 13 illustrates an embodiment in which the flat tubes have been formed in one piece and soldered with a longitudinal seam.

The plate stack of the exhaust gas heat exchanger of the present invention can be formed from a number of pairs of plates 1 which are connected at their longitudinal edges 10 to form a flat tube 2. Each flat tube 2 can include a turbulator 3 through which exhaust gas flows. In each case, a coolant duct 5, which is equipped with flow directing elements 6, is arranged between two flat tubes 2. In some embodiments, each of the aforementioned components are manufactured from stainless steel sheets. In other embodiments, less than all of the aforementioned components can be manufactured from stainless steel sheets. In still other embodiments, other materials, including composites and alloys, can also or alternatively be used.

In the illustrated embodiment, the flow directing elements 6 are formed from a corrugated plate 7. Ducts 13 with inlets and outlets 14, 15 are formed in the corrugated plate 7. At least some of the ducts 13 in the coolant inlet area 16 can have a bent or nonlinear profile which divides or distributes the flow. The corrugated plates 7 can have bent-over longitudinal edges 17 which can each engage, at its longitudinal edges, the flat tube 2 which is arranged above it (see FIG. 3). In contrast, in the inlet area 16, planar edges have been provided on the flow elements 6.

Figure 4:
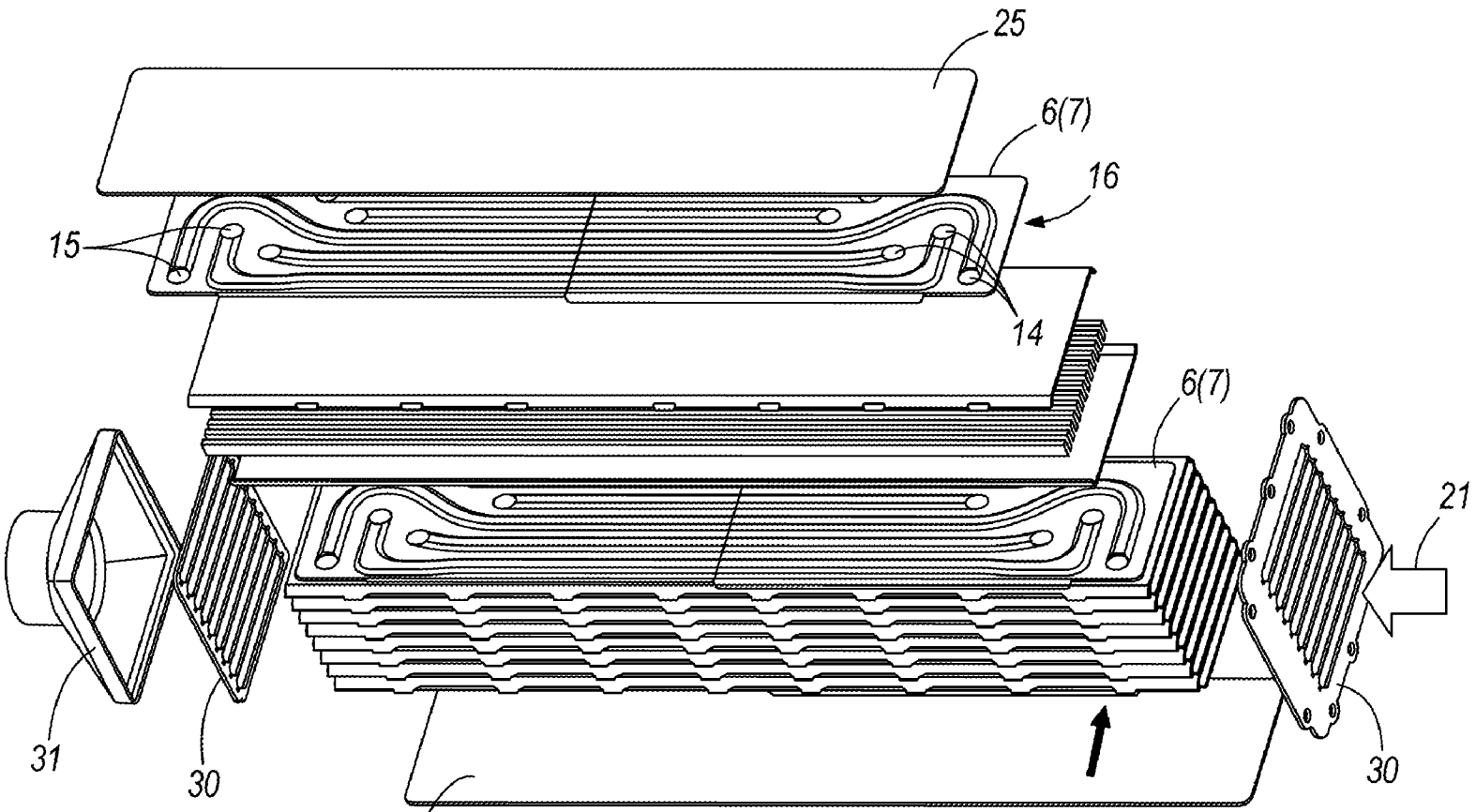
FIG. 4 is an exploded view of the stack shown in FIG. 3.
Figure 5:
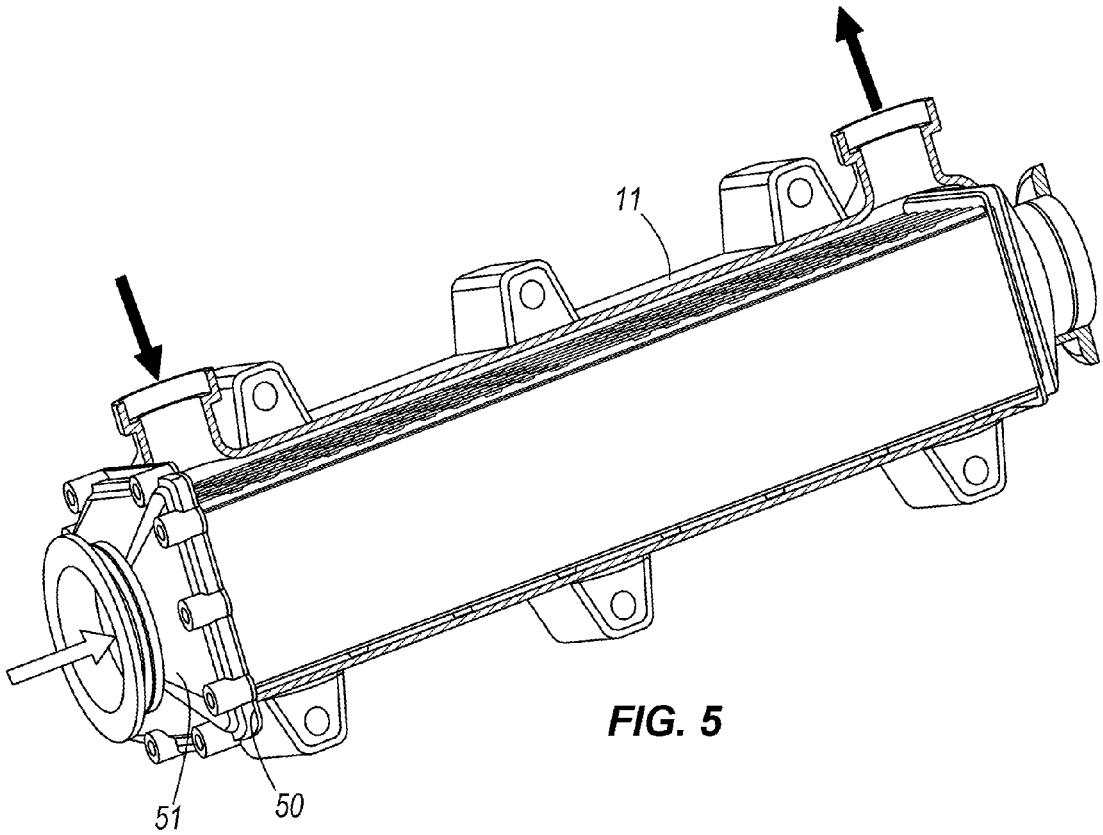
FIG. 5 is a sectional view of the stack shown in FIG. 3 supported in a housing.
Figure 6:
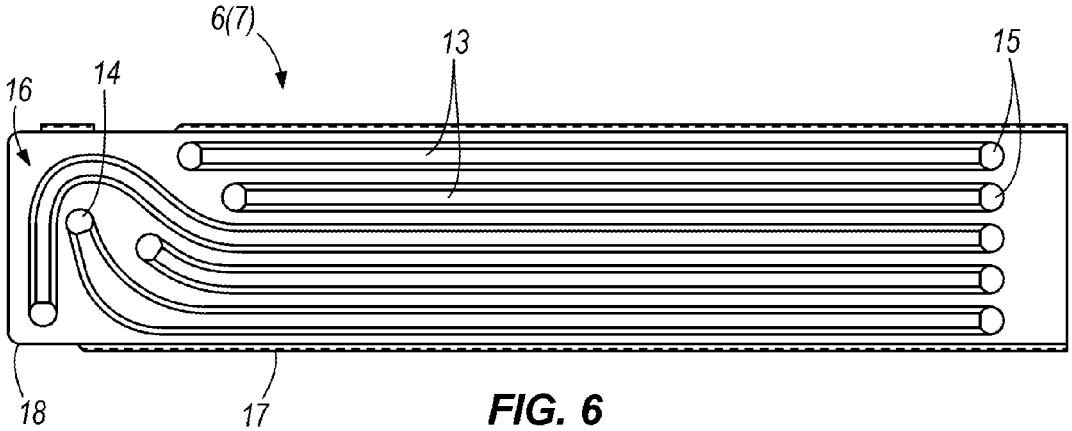
FIG. 6 is a plan view of a flow directing element according to another embodiment of the present invention.
Figure 7:
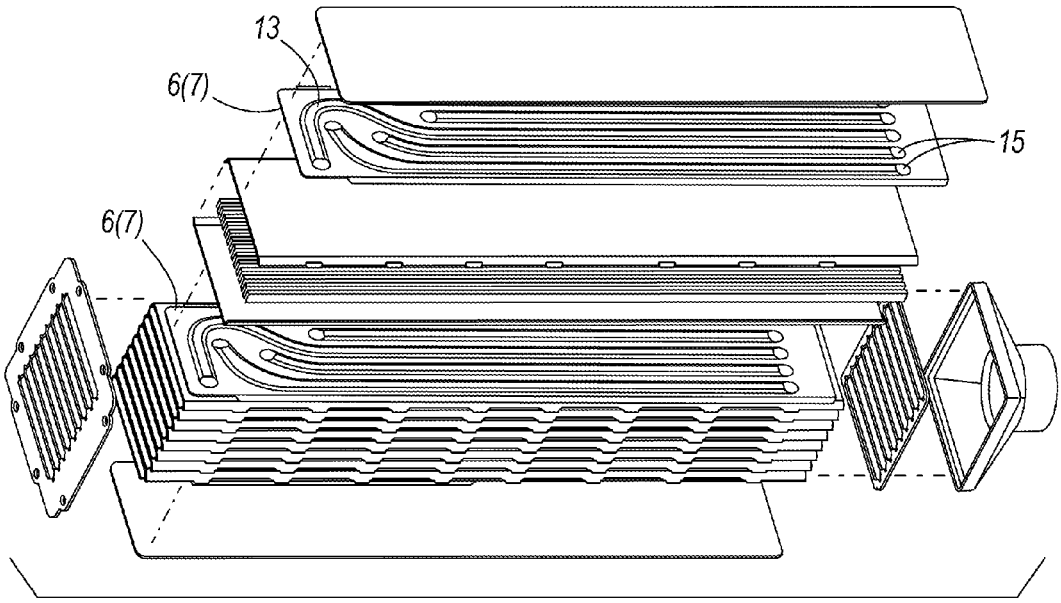
FIG. 7 is an exploded view of the stack shown in FIG. 6.

The aforementioned components are assembled according to FIGS. 4 or 7 to form the plate stack. The two figures differ from one another in that in FIG. 4 two-part flow directing elements 6 have each been arranged in a coolant duct 5, and in FIG. 7 the flow directing element 6 is in one piece. In FIG. 1, one of the two-part flow directing elements 6 is shown, and in FIG. 6 the one-piece flow directing element 6 has been illustrated.

A tube plate 30, which can also or alternatively be manufactured from stainless steel, and a header or a diffuser 31 are fitted onto the two ends of the plate stack. The plate stack is also closed off at the top and bottom ends by two side parts 25, which can also or alternatively be formed from stainless steel. The described structure is initially soldered, with all the parts which are shown in FIGS. 4 or 7. Then, in a further step, a seal 40 is fitted around the circumference of the plate stack. The seal 40 can ensure that the coolant is concentrated in the coolant ducts 5. The coolant can be prevented from flowing between the housing 11 and the circumference of the plate stack. This effect is enhanced by the described special structure of the longitudinal edges 17 on the corrugated plate 7. In a further step, the prefabricated unit of the plate stack is inserted into the housing 11, (described in more detail below) in such a way that changes in length which occur due to changing temperature stresses can be compensated for.

Figure 10:
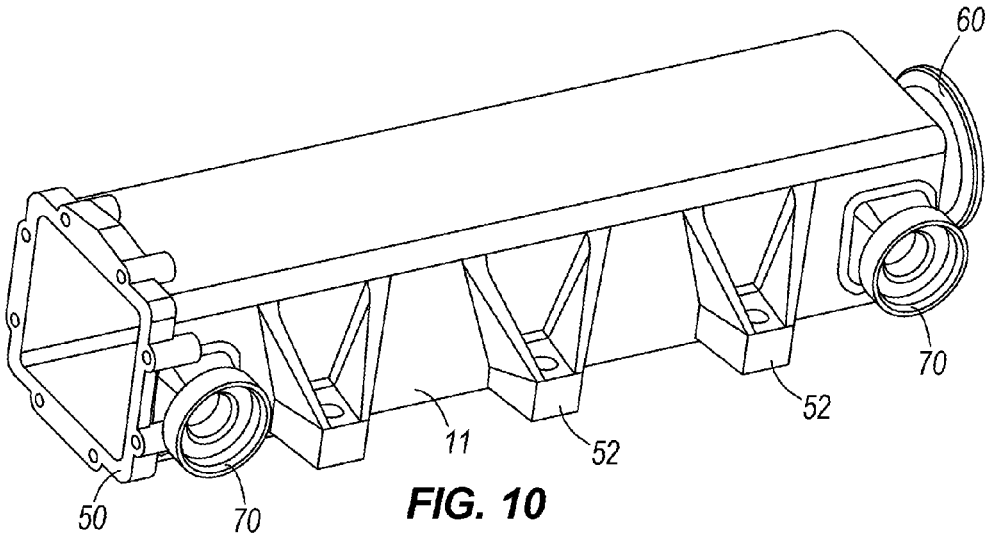
FIG. 10 is a perspective view of a housing of the exhaust gas heat exchanger shown in FIG. 9.

The housing 11 which has just been mentioned can be a die cast structure and can be made of aluminum (see FIG. 10). It can have a tapered outlet flange 60 for the exhaust gas which is dimensioned in such a way that the diffuser 31 which can be soldered to the plate stack fits into it. In addition, a groove 61 can be shaped to receive a sealing ring or another suitable seal 62 (see FIG. 9). From this illustration, it is clear that changes in length caused by changes in temperature can be compensated for by allowing movements in the longitudinal direction of the plate stack or of the housing 11. The two double block arrows on the left hand side in FIG. 9 indicate this.

The flow directing elements 6 additionally reduce the stresses or changes in shape caused by changing temperature stresses. At the other end of the housing 11, a further flange 50, to which the tube plate 30 of the plate stack and a further exhaust gas header 51 are formed. In addition, connectors 52 are formed on the housing 11 in order to be able to attach the exhaust gas heat exchanger to a connecting structure (not shown). Finally, connectors 70 have been formed on the housing 11 in order to allow the coolant to flow in and out of the coolant ducts 5 of the plate stack. Fluid flow in and out is ensured by the edges 18—not shaped in the inlet area 16 or in the outlet area—on the flow directing elements 6 which are arranged in substantially all of the coolant ducts 5.

Figure 8:
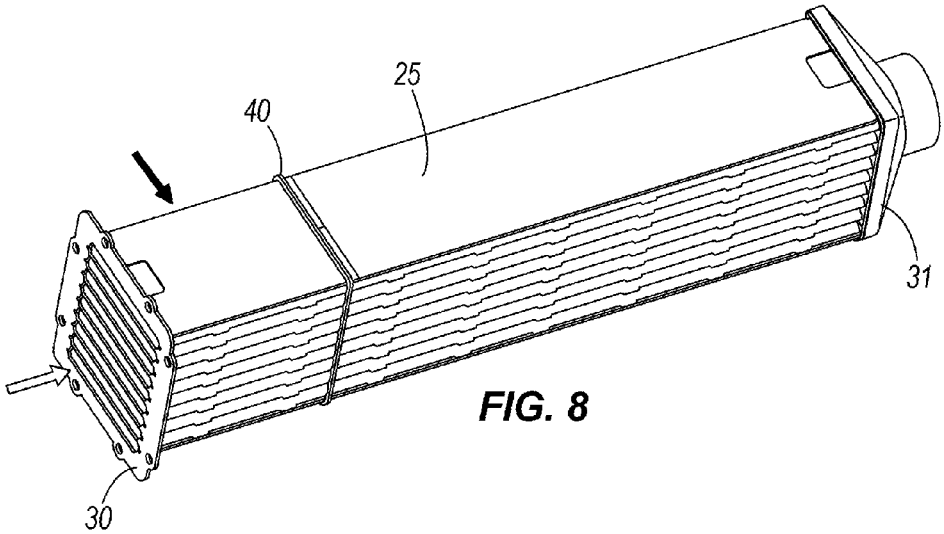
FIG. 8 is a view of a soldered stack.
Figure 9:
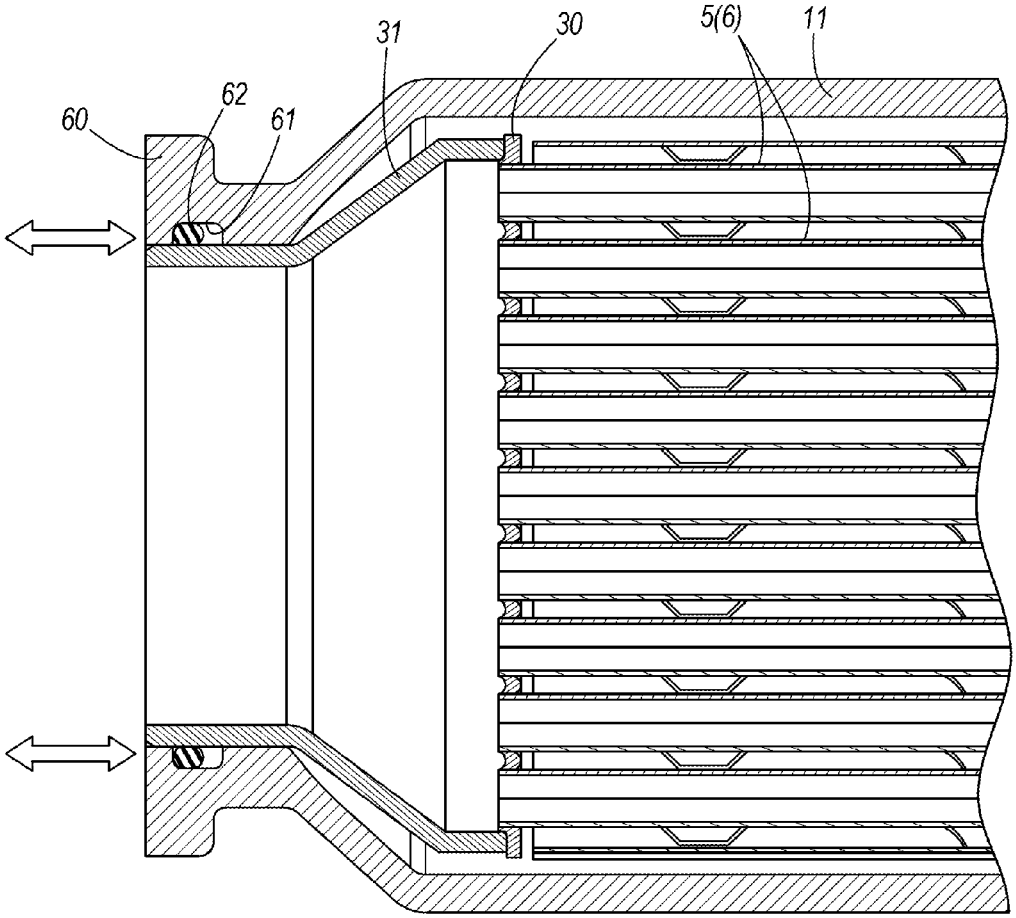
FIG. 9 is a partial longitudinal sectional view taken through a exhaust gas heat exchanger.
Figure 11:
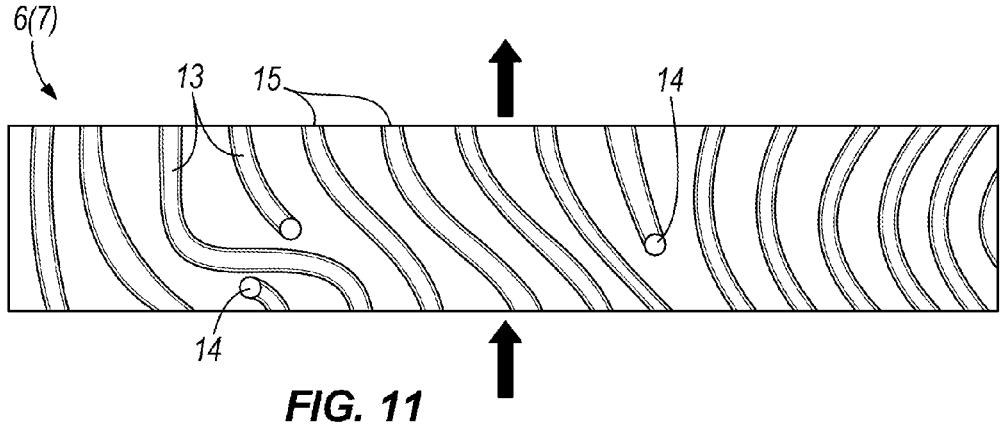
FIG. 11 is a plan view of a flow directing element according to yet another embodiment of the present invention.
Figure 12:
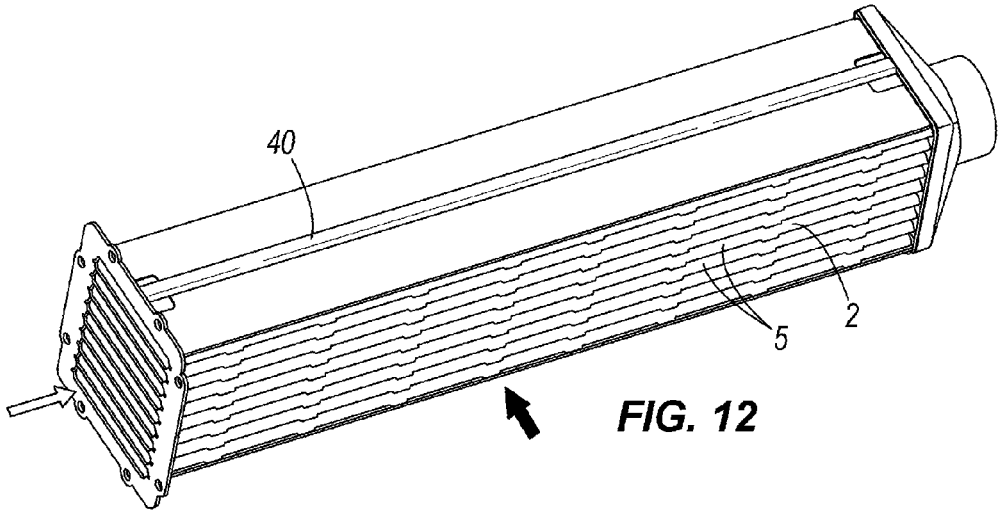
FIG. 12 is a view of a soldered stack.
Figure 13:
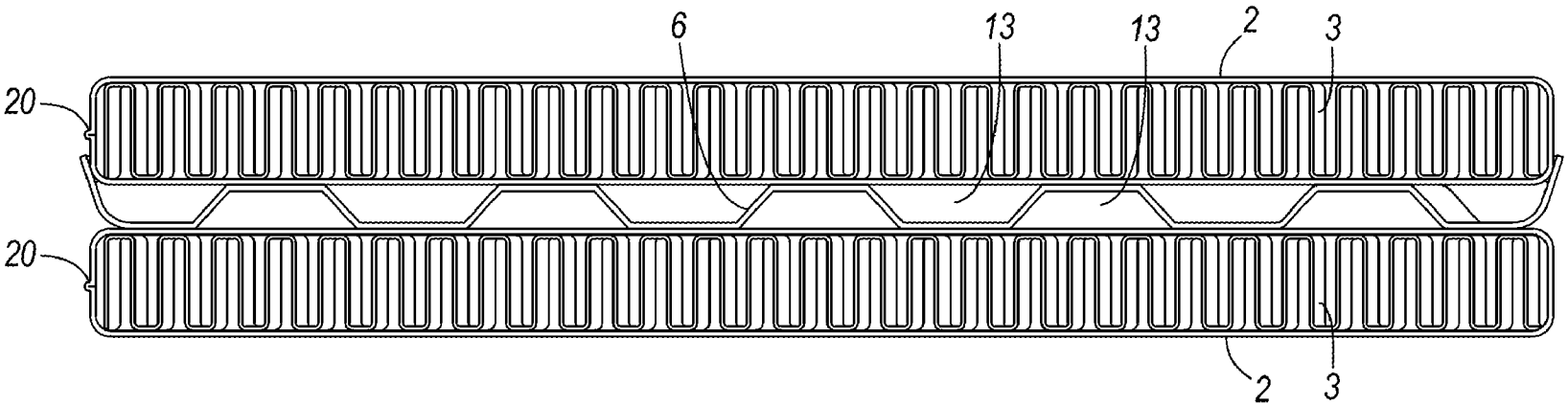
FIG. 13 is an enlarged view of a stack.

FIGS. 11 and 12 refer to an exemplary embodiment with ducts 13 which extend in the transverse direction of the exhaust gas heat exchanger and are formed in the flow directing element 6. FIG. 11 shows a plan view of such a flow directing element 6. The black block arrows show again the direction of the coolant. Some of the ducts 13 have inlets 14 or outlets 15 within the corrugated plate 6. In the majority of the ducts 13, the inlets or outlets have been arranged on the two longitudinal edges of the corrugated plate 6. FIG. 12 shows an illustration of the soldered exhaust gas heat exchanger which has external similarities to that shown in FIG. 8. However, in that figure, the flow directing elements 6 from FIG. 11 have not been used. The housing which is arranged around this stack has been correspondingly modified. It has not been shown for this individual case. In the figure, the arrows also show the direction of flow through the coolant and the exhaust gas. A visible difference from FIG. 8 is that the seal 40 extends in the longitudinal direction of the exhaust gas heat exchanger. Here too, the seal 40, which is intended to bear against the housing wall (not shown), ensures that the cooling liquid is concentrated on the coolant ducts 5.

Figure 3:
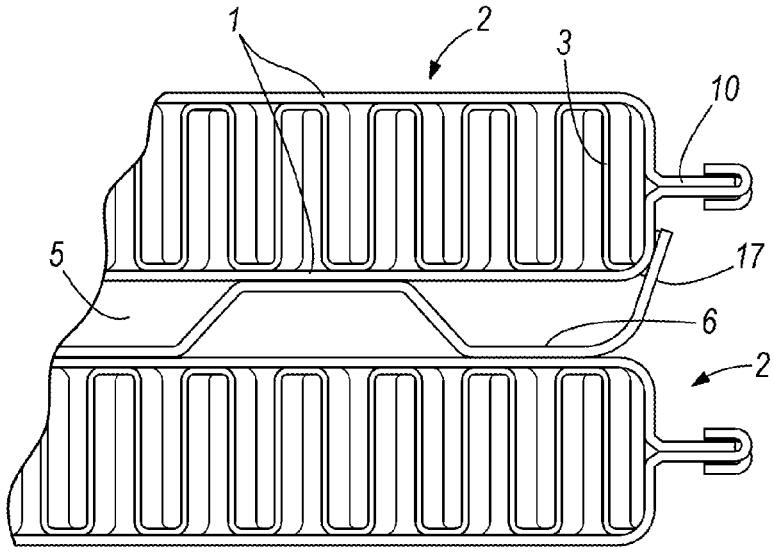
FIG. 3 is an enlarged end view of a portion of a stack according to the present invention.

Finally, FIG. 13 illustrates a stack which is similar to FIG. 3. Flat tubes 2 which are formed from a strip of sheet steel and are welded together along a longitudinal seam 20 are formed together into a stack.

Various features and advantages of the invention are set forth in the following claims.

What is claimed is:

1. An exhaust gas heat exchanger in an exhaust gas recirculation arrangement, the heat exchanger comprising:

a housing; and a stack at least partially surrounded by the housing and including flat tubes containing a turbulator through which exhaust gas flows and a coolant duct having a flow directing element arranged between two of the flat tubes and formed from a corrugated plate, wherein the corrugated plate includes a non-linear corrugation having bent walls defining a first duct in the coolant duct, the first duct having an inlet and an outlet, wherein the corrugation is nonlinear having bent walls so that the first duct includes a nonlinear profile between the inlet and the outlet and the first duct defines a first path segment extending in a transverse direction of the heat exchanger and a second path segment extending in a longitudinal direction of the heat exchanger, wherein changes in length are permitted between the stack and the housing;

wherein the corrugation further defines a second duct in the cooling duct, wherein the second duct includes an inlet and an outlet and a nonlinear profile between the inlet of the second duct and the outlet of the second duct and the second duct defines a first path segment extending in the transverse direction of the heat exchanger and a second path segment extending in the longitudinal direction of the heat exchanger;

wherein a coolant flow direction in the first path segment of the second duct is opposite a coolant flow direction in the first path segment of the first duct.

2. The exhaust gas heat exchanger of claim 1, wherein a coolant inlet area is provided in the vicinity of an exhaust gas inlet area so that the exhaust gas heat exchanger can have a parallel flow configuration, and wherein at least a portion of the first path segment is located in the coolant inlet area.

3. The exhaust gas heat exchanger of claim 1, wherein a coolant inlet area is provided, wherein, adjacent to the coolant inlet area, the corrugated plate is configured at two longitudinal edges in such a way that the coolant is present between the stack and the housing.

4. The exhaust gas heat exchanger of claim 3, wherein the longitudinal edges of the corrugated plate are bent over, to wrap around at least a portion of one of the two flat tubes to connect the corrugated plate to the one of the two flat tubes.

5. The exhaust gas heat exchanger of claim 3, wherein the corrugated plate has planar edges in the coolant inlet area.

6. The exhaust gas heat exchanger of claim 1, wherein a seal substantially prevents flow of coolant between the housing and the stack.

7. The exhaust gas heat exchanger of claim 1, wherein the stack includes two side parts which at least partially surround an external coolant duct.

8. The exhaust gas heat exchanger of claim 1, wherein the housing is formed of aluminum and is formed as a die cast part, and wherein the stack is formed as a stainless steel soldered structure, including tube plates provided on ends of the flat tubes and a diffuser.

9. The exhaust gas heat exchanger of claim 1, wherein the housing includes a connecting flange, which is matched to a diffuser, and wherein a groove and a seal located between the diffuser and a connecting flange permit the changes in length.

10. The exhaust gas heat exchanger of claim 1, wherein each of the flat tubes are formed from one of a pair of plates and a strip of sheet metal and welded to a longitudinal seam.

11. The exhaust gas heat exchanger of claim 1, wherein the first duct defines a first coolant flow path, wherein the second duct defines a second coolant flow path, and wherein the first coolant flow path is discrete from the second coolant flow path.

12. The exhaust gas heat exchanger of claim 1, wherein a coolant inlet area and a coolant outlet area are provided in the stack, wherein the inlet of the first duct is adjacent the coolant inlet area of the stack and the outlet of the first duct is adjacent the coolant outlet area of the stack.

13. An exhaust gas heat exchanger in an exhaust gas recirculation arrangement, the heat exchanger comprising:

a housing; and a stack at least partially surrounded by the housing and including flat tubes containing a turbulator through which exhaust gas flows and a coolant duct having a flow directing element arranged between two of the flat tubes and formed from a corrugated plate, wherein the corrugated plate includes a non-linear corrugation having bent walls defining a first duct in the coolant duct, the first duct having an inlet and an outlet, wherein the corrugation is nonlinear having bent walls so that the first duct includes a nonlinear profile between the inlet and the outlet and the first duct defines a first path segment extending in a transverse direction of the heat exchanger and a second path segment extending in a longitudinal direction of the heat exchanger, wherein changes in length are permitted between the stack and the housing;

wherein the corrugation further defines a second duct in the cooling duct, wherein the second duct includes an inlet and an outlet and a nonlinear profile between the inlet of the second duct and the outlet of the second duct and the second duct defines a first path segment extending in the transverse direction of the heat exchanger and a second path segment extending in the longitudinal direction of the heat exchanger;

wherein the inlet of the second duct is spaced from the inlet of the first duct in a direction along a coolant flow direction of the first path segment of the first duct.

14. An exhaust gas heat exchanger in an exhaust gas recirculation arrangement, the heat exchanger comprising:

a housing; and a stack at least partially surrounded by the housing and including flat tubes containing a turbulator through which exhaust gas flows and a coolant duct having a flow directing element arranged between two of the flat tubes and formed from a corrugated plate, wherein the corrugated plate includes a non-linear corrugation having bent walls defining a first duct in the coolant duct, the first duct having an inlet and an outlet, wherein the corrugation is nonlinear having bent walls so that the first duct includes a nonlinear profile between the inlet and the outlet and the first duct defines a first path segment extending in a transverse direction of the heat exchanger and a second path segment extending in a longitudinal direction of the heat exchanger, wherein changes in length are permitted between the stack and the housing;

wherein the corrugation further defines a second duct in the cooling duct, wherein the second duct includes an inlet and an outlet and a nonlinear profile between the inlet of the second duct and the outlet of the second duct and the second duct defines a first path segment extending in the transverse direction of the heat exchanger and a second path segment extending in the longitudinal direction of the heat exchanger;

wherein the corrugation further defines a third duct in the cooling duct, wherein the third duct includes an inlet and an outlet and a linear profile between the inlet of the third duct and the outlet of the third duct such that the third duct extends in the longitudinal direction of the heat exchanger between the inlet of the third duct and the outlet of the third duct.

* * * * *